US007750237B2

(12) United States Patent
Jiang et al.

(10) Patent No.: US 7,750,237 B2
(45) Date of Patent: Jul. 6, 2010

(54) ELECTRONIC DEVICE ENCLOSURE HAVING PROTECTIVE LAYER

(75) Inventors: Xiao-Gang Jiang, Shenzhen (CN); Hung-Chun Lu, Tu-Cheng (TW); Chien-Li Tsai, Tu-Cheng (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 981 days.

(21) Appl. No.: 11/511,920

(22) Filed: Aug. 29, 2006

(65) Prior Publication Data

US 2007/0045151 A1 Mar. 1, 2007

(30) Foreign Application Priority Data

Aug. 31, 2005 (CN) ..... 2005 1 0036997

(51) Int. Cl.
*H05K 5/00* (2006.01)
*B65D 71/00* (2006.01)

(52) U.S. Cl. ..... 174/50; 174/520; 174/559; 361/679.01; 361/679.02; 206/576

(58) Field of Classification Search ..... 174/50, 174/17 R, 520, 53, 57, 58, 66, 67, 559, 556; 220/3.2–3.9, 241, 242, 4.02; 361/600, 601, 361/679.01, 679.02, 679.03, 679.26; 190/111, 190/115, 113, 110, 109; 206/576; 402/500
See application file for complete search history.

(56) References Cited

U.S. PATENT DOCUMENTS

| | | | | | |
|---|---|---|---|---|---|
| 5,494,157 | A * | 2/1996 | Golenz et al. | ..... | 190/111 |
| 5,938,096 | A * | 8/1999 | Sauer et al. | ..... | 190/109 |
| 6,116,418 | A * | 9/2000 | Sadow | ..... | 190/110 |
| 6,145,661 | A * | 11/2000 | Jung | ..... | 190/113 |
| 6,149,001 | A * | 11/2000 | Akins | ..... | 206/576 |
| 6,163,450 | A * | 12/2000 | Kim | ..... | 174/50 |
| 6,935,498 | B1 * | 8/2005 | Ho | ..... | 190/115 |
| 7,107,370 | B2 * | 9/2006 | Weinzierl et al. | ..... | 402/500 |

FOREIGN PATENT DOCUMENTS

| | | |
|---|---|---|
| TW | 447729 | 7/2001 |

* cited by examiner

*Primary Examiner*—Angel R Estrada
(74) *Attorney, Agent, or Firm*—Zhigang Ma

(57) ABSTRACT

An electronic device enclosure having a protective layer includes a shell, a first protective piece, a second protective piece and a connecting piece. The shell includes an outer surface and an inner surface, the first protective piece covers the outer surface of the shell, and the second protective piece covers the inner surface of the shell. The connecting piece connects the first protective piece to the second protective piece so that they cooperatively enclose the shell.

17 Claims, 5 Drawing Sheets

ELECTRONIC DEVICE ENCLOSURE HAVING PROTECTIVE LAYER

BACKGROUND OF THE INVENTION

1. Field of the Invention

The present invention relates to an electronic device enclosure having a protective layer.

2. General Background

Typically, an electronic device enclosure is made of metal or plastic material, and the surface of the material will be plated or painted for protecting the enclosure. However, the surface layer of the enclosure is easily scraped and consequently the aesthetics of the electronic device is diminished. A protective layer covering the surface layer of the enclosure is now widely used to protect the surface layer of the enclosure and provide better wear endurance and aesthetic appearance.

An electronic device enclosure having a protective layer is disclosed in Taiwan Patent No. 447729, which describes a protective fitting for an enclosure of a portable computer. The fitting is made of leather, and a plurality of fixing portions is defined in the fitting. A plurality of threaded holes is defined in the enclosure corresponding to the fixing portions of the fitting. A plurality of screws is extended through the fixing portions and screwed in the corresponding threaded holes to fix the fitting on the enclosure. However, the method of fixing the fitting on the enclosure is complicated, and the fixing portions of the fitting are easily broken and lead to the fitting falling off.

What is desired, therefore, is an electronic device enclosure having a protective layer of sound construction, which is easily fixed or detached therefrom.

SUMMARY

In one preferred embodiment, an electronic device enclosure having a protective layer includes a shell, a first protective piece, a second protective piece, and a connecting piece. The shell includes an outer surface and an inner surface, the first protective piece covers the outer surface of the shell, and the second protective piece covers the inner surface of the shell. The connecting piece connects the first protective piece to the second protective piece so that they cooperatively enclose the shell.

Other advantages and novel features will become more apparent from the following detailed description of a preferred embodiments when taken in conjunction with the accompanying drawings, in which:

DETAILED DESCRIPTION OF THE EMBODIMENTS

Figure 1:
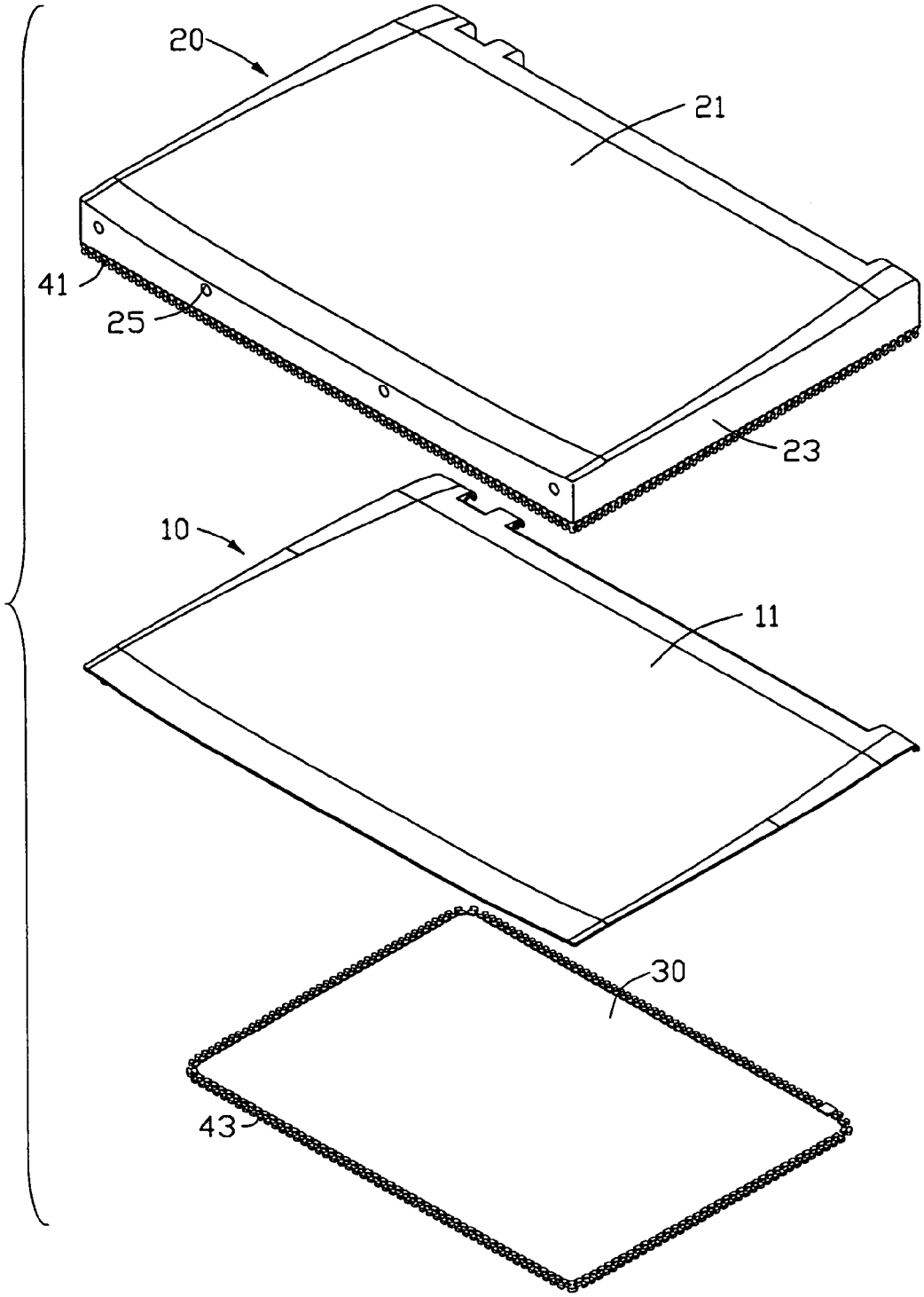
FIG. 1 is an exploded, isometric view of an electronic device enclosure having a protective layer in accordance with a first preferred embodiment of the present invention.
Figure 2:
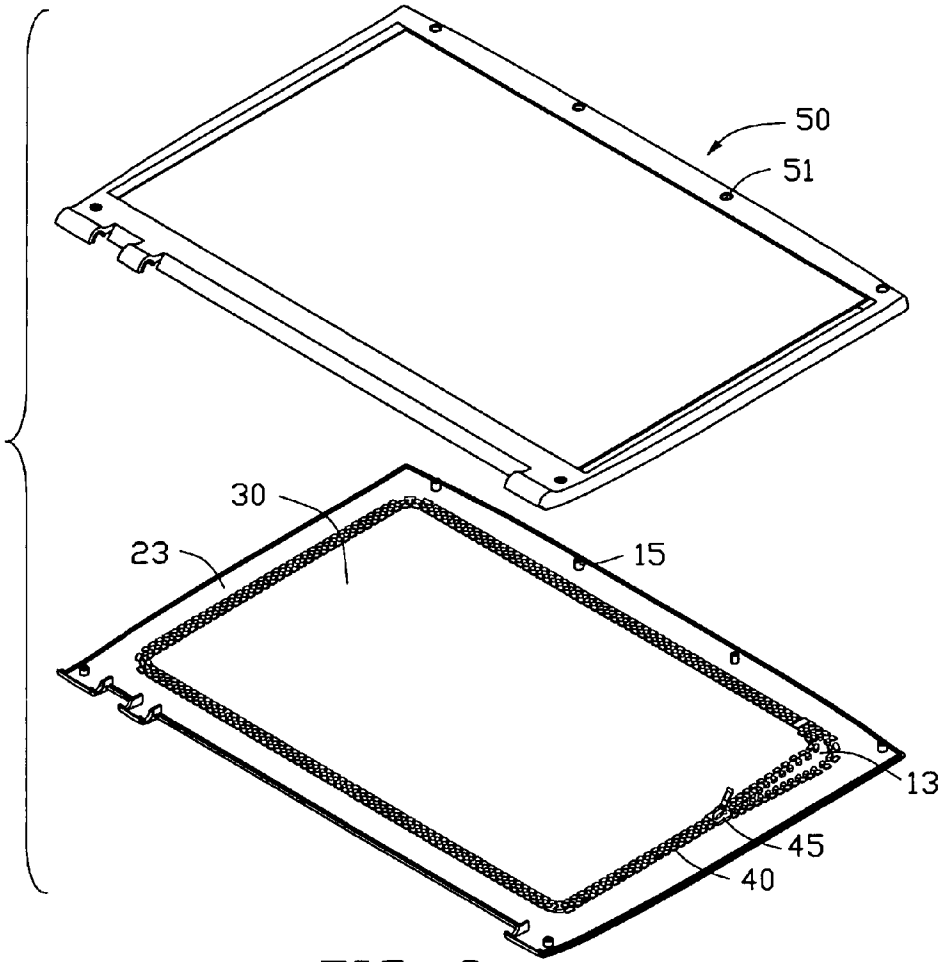
FIG. 2 is an assembled view of FIG. 1, but with an added frame.

Referring to FIGS. 1 and 2, an electronic device enclosure is provided in accordance with a first preferred embodiment of the present invention, which includes a shell 10, a first protective piece 20, a second protective piece 30, a connecting piece, and a frame 50. In this embodiment, the shell 10 is a shell of a cover unit of a portable computer.

The shell 10 includes an outer surface 11 and an inner surface 13, a plurality of fixing portions 15 is formed adjacent edges of the inner surface 13. A plurality of through holes 51 are defined in the frame 50, corresponding to the fixing portions 15 of the shell 10.

The first protective piece 20 includes a main body 21 for fittingly covering the outer surface 11 of the shell 10. A hem 23 is formed from four edges of the main body 21 for covering four sides of the shell 10 and the edges of the inner surface 13 of the shell 10. A plurality of apertures 25 are defined in the hem 23, corresponding to the fixing portions 15 of the inner surface 13 of the shell 10, for extension of the fixing portions 15 therethrough and being fixed on the inner surface 13.

The second protective piece 30 covers a substantial portion of the inner surface 13 of the shell 10 and is connectable to the hem 23 of the first protective piece 20 in the inner surface 13 of the shell 10. In this embodiment, the first protective piece 20 and the second protective piece 30 are made of leather.

In this embodiment, the connecting piece is a zipper 40. The zipper 40 includes a first engaging portion 41 set in four edges of the first protective piece 20, and a second engaging portion 43 set in four edges of the second protective piece 30. A fastener 45 is installed on the first engaging portion 41 for connecting the first engaging portion 41 and the second engaging portion 43.

Figure 3:
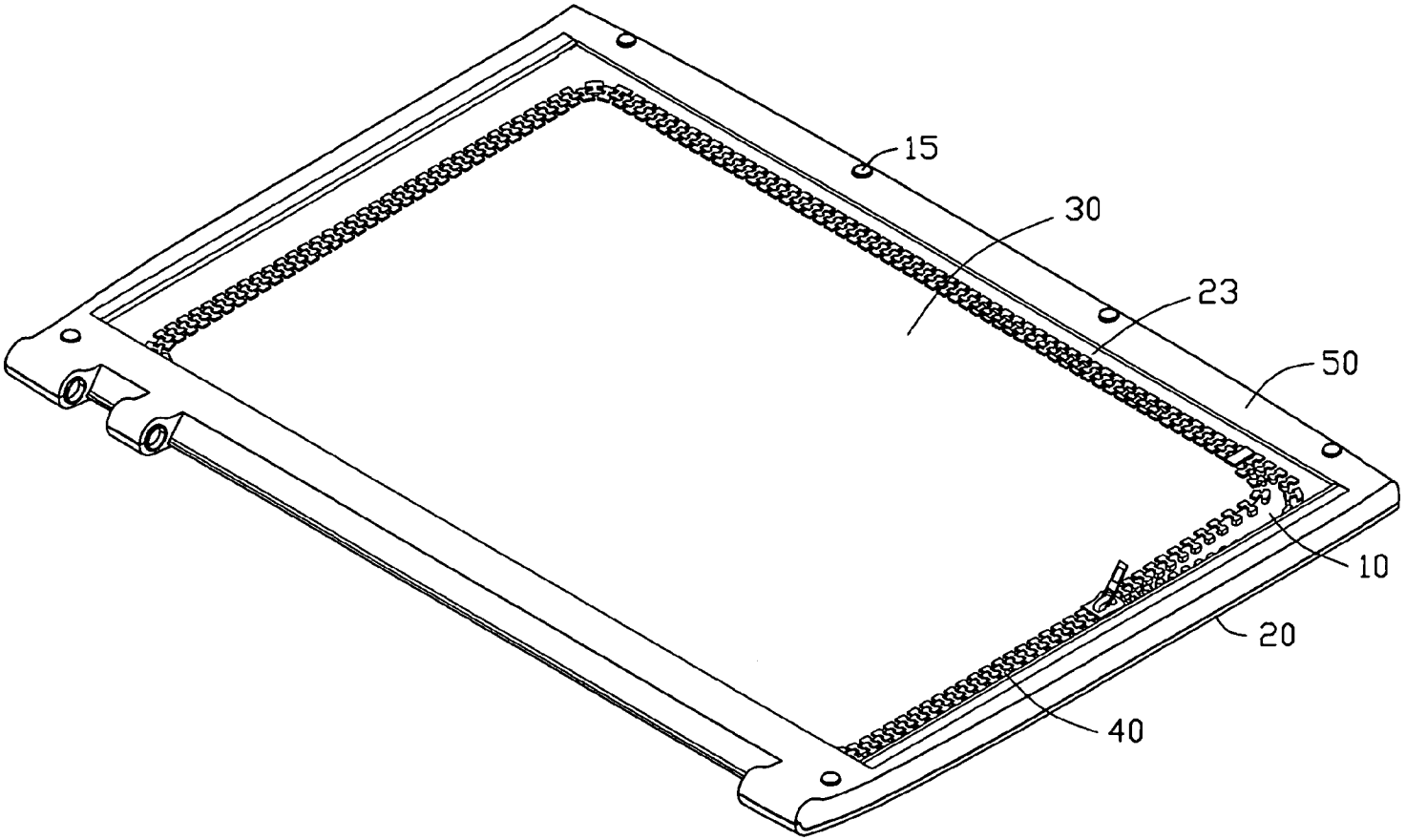
FIG. 3 is an assembled view of FIG. 2.

Referring to FIG. 3, in assembly, the outer surface 11 of the shell 10 is covered with the first protective piece 20, and the hem 23 of the first protective piece 20 is folded toward the inner surface 13 of the shell 10, with the fixing portions 15 of the shell 10 extending through the corresponding apertures 25 of the first protective piece 20. With the second protective piece 30 in place over the inner surface 13, the second engaging portion 43 of the second protective piece 30 is engaged with the first engaging portion 41 of the first protective piece 20 by driving the fastener 45, thereby the shell 10 is enclosed by the first protective piece 20 and the second protective piece 30. After all of elements such as a Liquid Crystal Display (LCD) panel are installed in the shell 10, covering the frame 50, the fixing portions 15 of the shell 10 engage in the corresponding through holes 51 of the frame 50, thereby the frame 50 is fixed on the shell 10 and the first protective piece 20 is tightly pressed between the shell 10 and the frame 50.

To detach or replace the first protective piece 20 and the second protective piece 30, the frame 50 and the elements inside are first removed, and then the first engaging portion 41 and the second engaging portion 43 are separated from each other by driving the fastener 45, then the second protective piece 30 is removed. Opening the folded hem 23, the first protective piece 20 is then detached from the shell 10.

Figure 4:
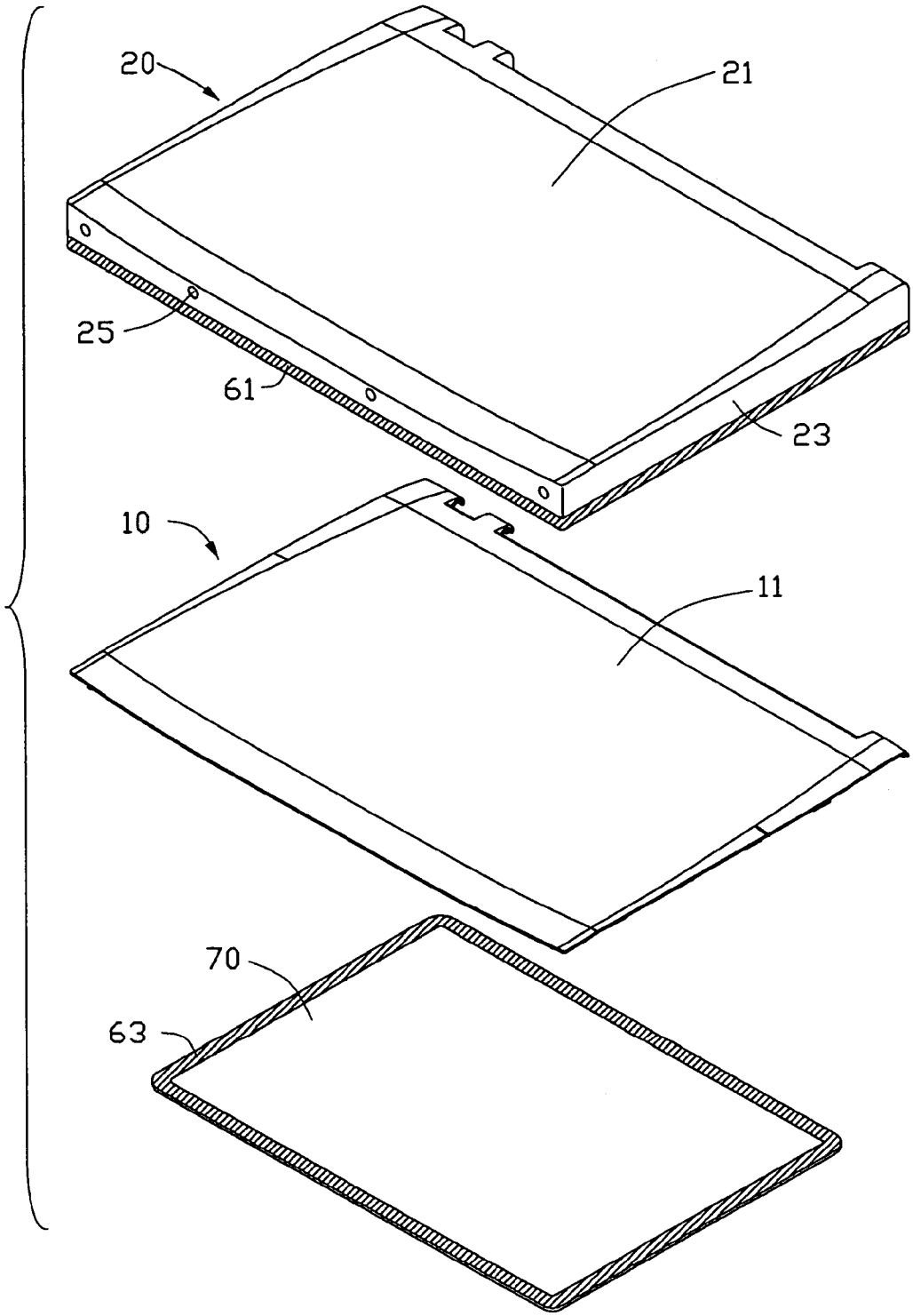
FIG. 4 is an exploded, isometric view of an electronic device enclosure having a protective layer in accordance with a second preferred embodiment of the present invention.
Figure 5:
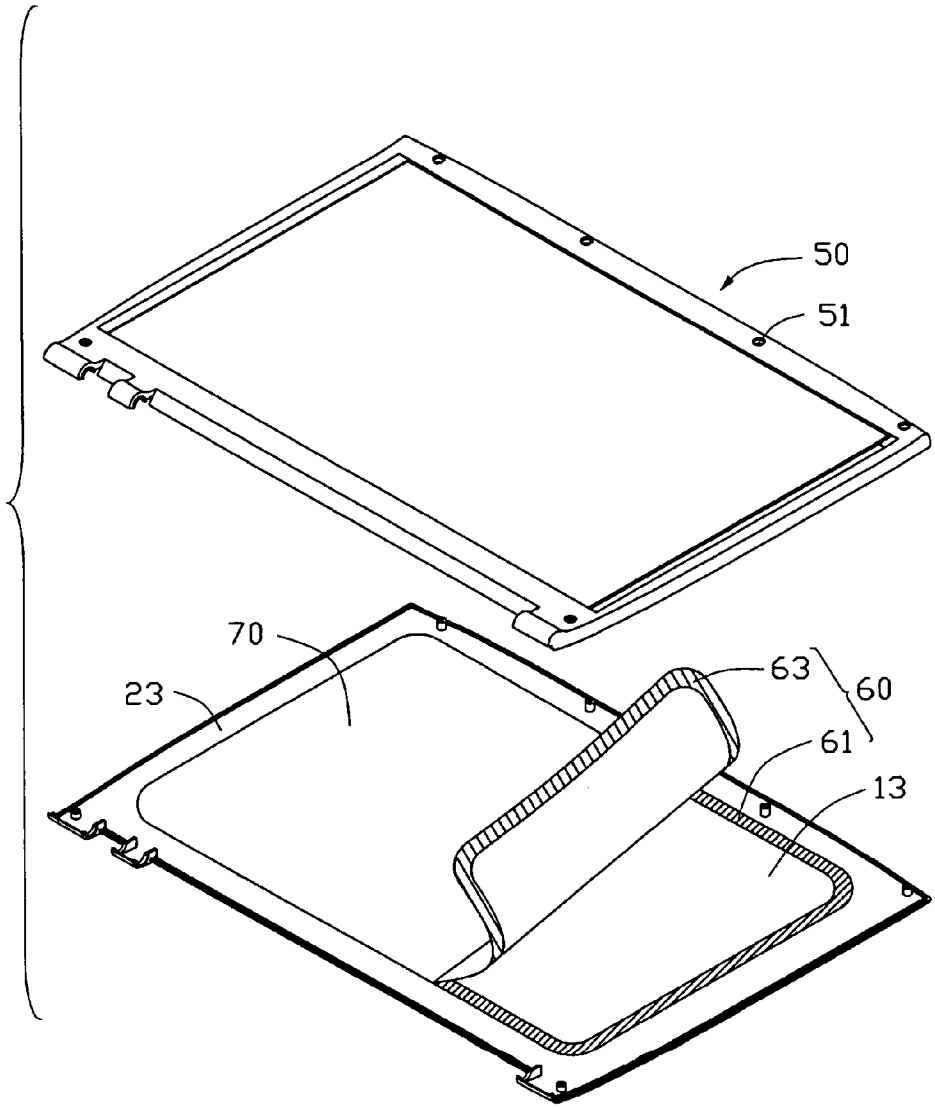
FIG. 5 is an assembled view of FIG. 4, but with an added frame.

Referring to FIGS. 4 and 5, an electronic device enclosure is provided in accordance with a second preferred embodiment of the present invention, which includes the same shell 10, first protective piece 20, and frame 50 as the first embodiment, and further includes a second protective piece 70, and a connecting piece. In this embodiment, the second protective piece 70 covers a substantial portion of the inner surface 13 of the shell 10 overlapping the edge of the hem 23 of the first protective piece 20 in the inner surface 13 of the shell 10. The connecting piece is composed of a hook and loop fabric or Velcro fastener 60, the fastener 60 includes a first engaging portion 61 set in four edges of the first protective piece 20, and a second engaging portion 63 set in four sides of the second protective piece 70.

In assembly, the outer surface 11 of the shell 10 is covered with the first protective piece 20, and the hem 23 of the first protective piece 20 is folded toward the inner surface 13 of the shell 10, with the fixing portions 15 of the shell 10 extending through the corresponding apertures 25 of the first protective piece 20. With the second protective piece 70 in place on the inner surface 13, the second engaging portion 63 of the second protective piece 70 is covered and affixed on the first engaging portion 61 by a hook and loop fastening effect of the fastener 60, thereby the shell 10 is enclosed by the first protective piece 20 and the second protective piece 70. After all of elements such as a Liquid Crystal Display (LCD) panel are installed in the shell 10, covering the frame 50, the fixing portions 15 of the shell 10 engage in the corresponding through holes 51 of the frame 50, thereby the frame 50 is fixed on the shell 10 and the first protective piece 20 is tightly pressed between the shell 10 and the frame 50.

To detach or replace the first protective piece 20 and the second protective piece 70, the frame 50 and the elements inside are first removed, and then the second engaging portion 63 is pulled up to be separated from the first engaging portion 61, then the second protective piece 70 is removed. Opening the folded hem 23, the first protective piece 20 is then detached from the shell 10.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments.

What is claimed is:

1. An electronic device enclosure having a protective layer, comprising:

a shell comprising an outer surface and an inner surface;

a first protective piece for covering the outer surface of the shell;

a second protective piece for covering a substantial portion of the inner surface of the shell;

a connecting piece for connecting the first protective piece to the second protective piece to enclose the shell, wherein the first protective piece comprises a main body for covering the outer surface of the shell, and a hem formed from four edges of the main body for covering four sides of the shell and edges of the inner surface of the shell; and a frame fixed on the inner surface of the shell, wherein the hem of the first protective piece is tightly pressed between the shell and the frame.

2. The electronic device enclosure as claimed in claim 1, wherein the connecting piece comprises a first engaging portion set in four edges of the first protective piece, and a second engaging portion set in four edges of the second protective piece.

3. The electronic device enclosure as claimed in claim 2, wherein the connecting piece is a zipper comprising a fastener.

4. The electronic device enclosure as claimed in claim 2, wherein the connecting piece is a hook and loop fabric fastener.

5. The electronic device enclosure as claimed in claim 1, wherein a plurality of fixing portions is formed adjacent the edges of the inner surface of the shell, and a plurality of through holes are defined in the frame, corresponding to the fixing portions of the shell.

6. The electronic device enclosure as claimed in claim 5, wherein a plurality of apertures are defined in the hem of the first protective piece, corresponding to the fixing portions of the inner surface of the shell.

7. The electronic device enclosure as claimed in claim 1, wherein the first protective piece is made of leather.

8. An electronic device enclosure having a protective layer, comprising:

a shell comprising an outer surface and an inner surface;

a first protective piece for covering the outer surface of the shell; and a second protective piece covering a substantial portion of the inner surface of the shell for connecting four edges of the first protective piece; and a frame fixed on the shell, and the first protective piece pressed between the shell and the frame.

9. The electronic device enclosure as claimed in claim 8, wherein the first protective piece comprises a main body for covering the outer surface of the shell, and a hem formed from four edges of the main body for covering four sides of the shell.

10. The electronic device enclosure as claimed in claim 8, further comprising a connecting piece for connecting the first protective piece to the second protective piece, wherein the connecting piece comprises a first engaging portion set in four edges of the first protective piece and a second engaging portion set in four sides of the second protective piece.

11. The electronic device enclosure as claimed in claim 10, wherein the connecting piece is a zipper comprising a fastener.

12. The electronic device enclosure as claimed in claim 10, wherein the connecting piece is a hook and loop fabric fastener.

13. The electronic device enclosure as claimed in claim 8, wherein a plurality of fixing portions is formed adjacent edges of the inner surface of the shell, and a plurality of through holes are defined in the frame, corresponding to the fixing portions of the shell.

14. The electronic device enclosure as claimed in claim 8, wherein the first protective piece and the second protective piece are made of leather.

15. An electronic device comprising:

an enclosure of said electronic device for enclosing said electronic device, said enclosure defining a shell partially enclosing said electronic device along a side of said electronic device, said shell defining an outer surface facing away from said electronic device and an inner surface facing oppositely;

a first protective piece installable against said outer surface of said shell to extendably cover said outer surface of said shell, at least one hem extending away from said first protective piece extendable against said inner surface of said shell;

a second protective piece physically discrete from said first protective piece and installable against said inner surface of said shell, said second protective piece extendably reachable to said at least one hem of said first protective piece so as to extendably cover said inner surface of said shell together with said at least one hem;

means for connecting said at least one hem of said first protective piece with said second protective piece; and a frame fixed on the inner surface of the shell, wherein said at least one hem of said first protective piece is pressed between the shell and the frame.

16. The electronic device as claimed in claim 15, wherein said means is a zipper.

17. The electronic device as claimed in claim 15, wherein said means is a fabric hook and loop fastener.

* * * * *